US005082148A

United States Patent [19]

Dunning

[11] Patent Number: 5,082,148

[45] Date of Patent: Jan. 21, 1992

[54] POWDER DISPENSER

[76] Inventor: Walter B. Dunning, 924 Riesling Dr., Pleasanton, Calif. 94566

[21] Appl. No.: 595,257

[22] Filed: Oct. 9, 1990

[51] Int. Cl.[5] ..... B67D 5/64

[52] U.S. Cl. ..... 222/162; 222/634; 222/401; 406/132

[58] Field of Search ..... 222/162, 163, 630, 631, 222/634, 401, 457; 239/333, 345; 137/516.25, 512.4, 268; 406/96, 98, 128, 132

[56] References Cited

U.S. PATENT DOCUMENTS

| | | | |
|---|---|---|---|
| 1,272,283 | 7/1918 | Madden . | |
| 1,540,198 | 6/1925 | Treadwell . | |
| 1,777,278 | 9/1930 | Huntington . | |
| 1,930,872 | 10/1933 | Blackmum | 299/89 |
| 2,068,871 | 1/1937 | Rose | 222/634 |
| 2,156,268 | 5/1939 | Rose | 43/147 |
| 2,215,937 | 9/1940 | Rutkowski | 43/147 |
| 2,525,742 | 10/1950 | Weiss et al. | 169/33 |
| 2,974,879 | 3/1961 | Raehs et al. | 239/357 |
| 3,036,781 | 5/1962 | Raehs et al. | 239/361 |
| 3,092,331 | 6/1963 | Kiashek | 239/350 |
| 3,733,010 | 5/1973 | Riccio | 222/193 |
| 4,084,731 | 4/1978 | Ayres | 137/512.4 X |
| 4,472,091 | 9/1984 | Callahan | 406/132 |

*Primary Examiner*—Michael S. Huppert
*Assistant Examiner*—Gregory L. Huson
*Attorney, Agent, or Firm*—Delbert J. Barnard

[57] ABSTRACT

A powder dispenser basically characterized by a powder reservoir (14) positioned above a mixing chamber (18). The mixing chamber (18) is separated from the powder reservoir by a first wall (16). The first wall (16) includes a powder outlet (22) bordered by a downwardly directed upper valve seat (24). The mixing chamber (18) includes a second wall (20) spaced axially below the first wall (16). The second wall (20) includes an air inlet (32) bordered by an upwardly directed lower valve seat (28). An axially movable valve plug (32) is located within the mixing chamber (18). The valve plug (32) has upper and lower surfaces (34 and 36), with the lower surface normally resting on the lower valve seat (28), and its upper surface (34) normally spaced axially from the upper valve seat (24). The dispenser also includes a pump for delivering air to and through the air inlet (26), and against the lower surface of the valve plug (32), to move the valve plug upwardly and place its upper surface (34) into seating engagement with the upper valve seat. Air flow through the air inlet (26) and into and through the mixing chamber (18). As it flows through the mixing chamber (18) the air picks up the powder and carries it out through a discharge passageway (40) for dispensing the powder. Airflow from the pump vibrates the valve plug (32) and an upwardly extending member (148) which is secured to the valve plug (32). The movement disturbs the powder in the reservoir, encouraging powder to flow downwardly through opening (22) into the mixing chamber (18). A cam (152) and cam follower (150) system is provided to urge the valve plug (32) upwardly into a seated position against a circular seat (24), in response to a rotation of an upper plunger part (46) relative to a lower plunger part (78).

33 Claims, 4 Drawing Sheets

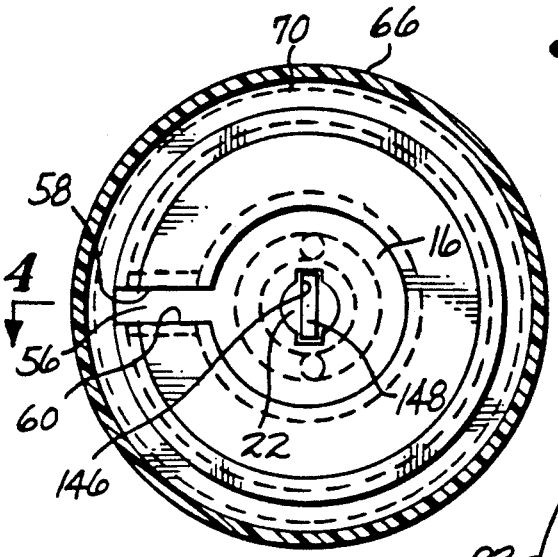
Fig.6
Fig13
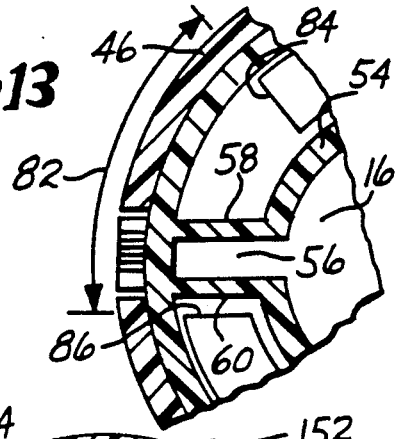
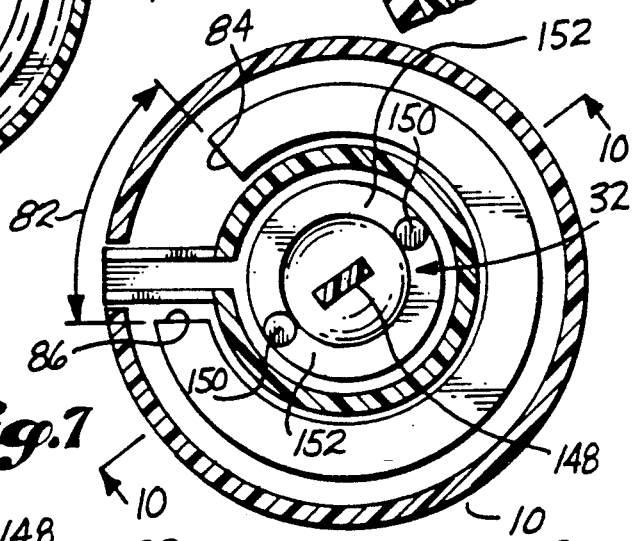
Fig.7
Fig.8
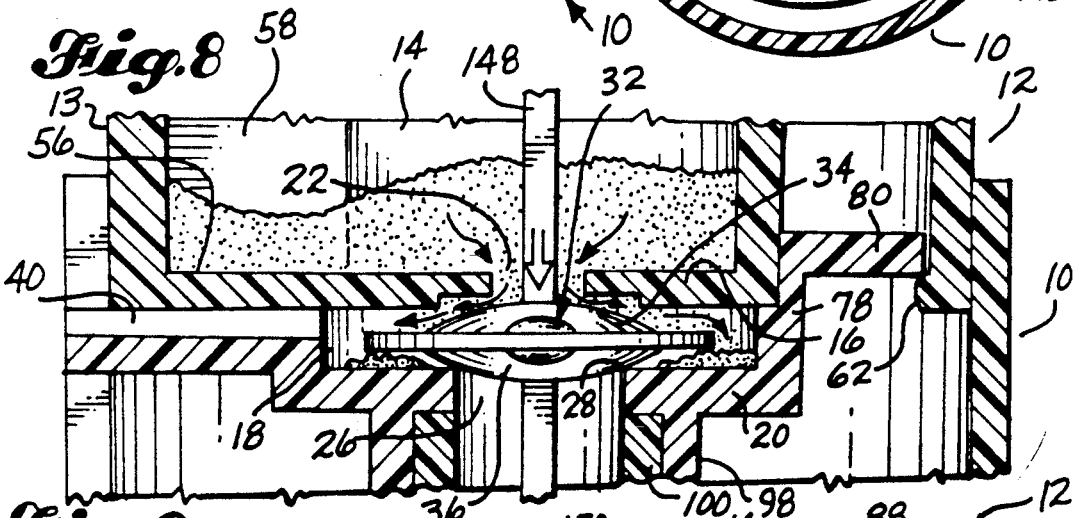
Fig.9
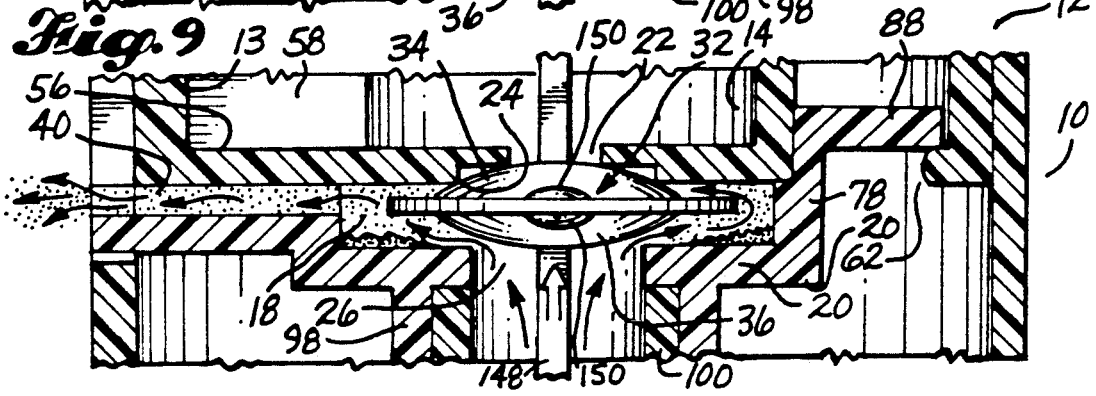

POWDER DISPENSER

TECHNICAL FIELD

The present invention relates to powder dispensers and, more particularly, to the provision of a powder dispenser which discharges a measured amount of a dry powder within an atmospheric air carrier stream.

BACKGROUND INFORMATION

It is desirable to be able to dispense a dry powder product as a dry stream. It is also desirable to use atmospheric air as a fluidizing agent for forming the stream. Air is nonpolluting and can be formed into a stream by use of relatively simple hand pumps. Hand pump powder dispensers existing in the patent literature are disclosed by U.S. Pat. No. 1,272,283, granted July 9, 1918, to Jeremiah M. Madden; U.S. Pat. No. 1,540,198, granted June 2, 1925, to Albert P. Treadwell; U.S. Pat. No. 1,777,278, granted Sept. 30, 1930, to Harold O. Huntington; U.S. Pat. No. 2,156,268, granted May 9, 1939, to William H. Rose; U.S. Pat. No. 2,215,937, granted Sept. 24, 1940, to Walter L. Rutkowski; U.S. Pat. No. 2,525,742, granted Oct. 10, 1950 to Thomas C. Weiss and Sam King; U.S. Pat. No. 2,974,879, granted Mar. 14, 1961, to Wilhelm Raehs and Hans Rauchmann and U.S. Pat. No. 3,036,781, granted May 29, 1962, to Wilhelm Raehs and Hans Rauchmann.

A principal object of the present invention is to provide an improved dry powder dispenser which is simple in construction and which operates to distribute the powder evenly over a large surface area. Another object of the invention is to provide an inexpensive package for a dry powder product into which an air pump is incorporated and arranged to provide a dry powder entraining stream of air in response to a simple depressing of a top portion of the package.

DISCLOSURE OF THE INVENTION

The powder dispenser of the present invention is basically characterized by a powder reservoir positioned above a mixing chamber which is separated from the powder reservoir by a first wall. This first wall includes a powder outlet bordered by a downwardly directed upper valve seat. The mixing chamber includes a second wall spaced axially below the first wall. The second wall includes an air inlet bordered by an upwardly directed lower valve seat. An axially movable valve plug is located within the mixing chamber. The valve plug has upper and lower surfaces, and its lower surface is normally resting on the lower valve seat, and its upper surface is normally spaced axially from the upper valve seat. This provides a gap through which powder can gravitate from the powder reservoir downwardly into the mixing chamber. The dispenser also includes means to deliver air to and through the air inlet and against the lower surface of the valve plug, to move the valve plug upwardly and place the upper surface of the valve plug into seating engagement with the upper valve seat. This provides a gap between the lower surface of the valve plug and the lower valve seat. The air flows through this gap and into and through the mixing chamber. As it flows through the mixing chamber the air picks up the powder and carries the powder out through a discharge passageway. The powder entraining air stream dispenses the powder over a large area.

In preferred form, the powder dispenser includes a tubular body that is adapted to be held in a user's hand.

The tubular body includes an open upper end into which a plunger is telescopically received. The plunger includes an upper portion which normally projects a distance above the tubular body and a lower portion which is located within the tubular body. The upper portion of the plunger includes the powder reservoir. The plunger also includes the mixing chamber. A spring located within the tubular body normally biases the plunger upwardly. This spring is yieldable in response to a downward pressing force on the plunger, so as to permit the plunger to move downwardly into the tubular body in response to such force. A pump is located within the tubular body and such pump is operable by the downward movement of the plunger to compress air and pump it upwardly to and through the compressed air inlet It is in this manner that the air stream is formed which flows into and through the mixing chamber to entrain powder and deliver it out from the dispenser as a dry stream.

In preferred form, the upper portion of the plunger is rotatable relative to the lower portion of the plunger. The second or lower wall of the mixing chamber is provided with one or more cams which, in response to such rotation, cooperate with confronting cam followers on the valve plug to move the valve plug axially upwardly into a seating engagement with the upper valve seat to in that manner close the powder outlet.

Other important aspects of the invention include the manner of constructing the various components of a preferred embodiment of the dispenser so that they can be easily assembled to provide an inexpensive package for the dry powder product. It is another object to provide such a package which in addition functions to dispense the dry powder in the form of a dry stream without the use of any pollutants. Other objects, features and advantages of the invention are hereinafter described as a part of the description of the best mode.

BRIEF DESCRIPTION OF THE DRAWINGS

In the drawings, like reference characters designate like parts throughout the several views.

FIG. 6 is a cross-sectional view taken substantially along line 6—6 of FIG. 4;

FIG. 7 is a cross-sectional view taken substantially along line 7—7 of FIG. 4, but showing the plunger rotated in position to close the powder opening;

FIG. 8 is an enlarged scale axial sectional view in the vicinity of the valve plug showing the valve plug in a down position and showing powder particles gravitating through a powder outlet;

FIG. 9 is a view like FIG. 8, but showing the valve plug moved into an up position, by air flow and showing the air flow entraining powder and discharging it from the sprayer;

FIG. 13 is a fragmentary sectional view taken substantially along line 13—13 of FIG. 5.

BEST MODE FOR CARRYING OUT THE INVENTION

Figure 1:
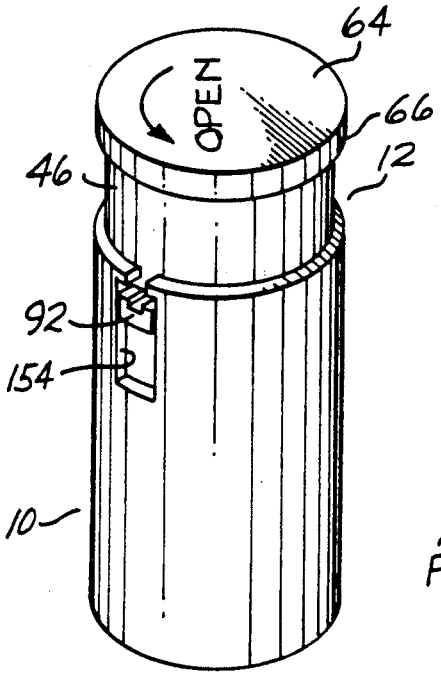
FIG. 1 is a pictorial view taken from above and looking towards the front and one side of the sprayer, showing the plunger in an up position.
Figure 2:
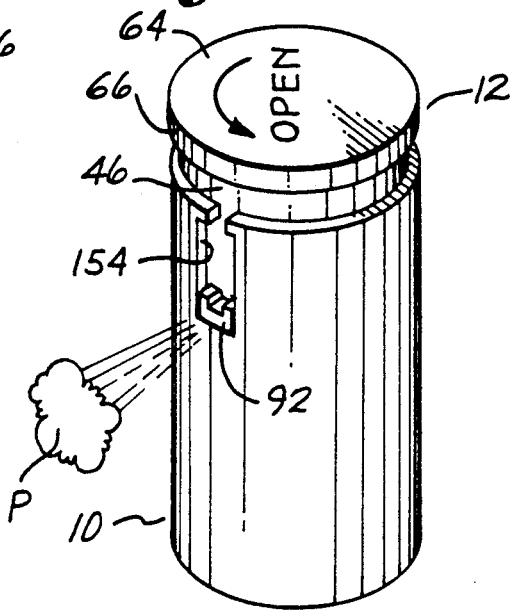
FIG. 2 is a view like FIG. 1 but showing the plunger depressed, and further showing a spray of powder exiting from the outlet of the sprayer.

Referring to FIGS. 1 and 2, the preferred embodiment of the invention is basically characterized by a tubular body 10 that is of a size to be held conveniently within a user's hand, and a plunger 12 that is telescopically received within the body 10 and which is moved up and down by a simple downward movement on the top of the plunger 12. A user may grasp the body 10 with his or her hand while placing a forefinger on the top of the plunger 12. A downward application of pressure by the forefinger on the plunger 12 moves the plunger 12 down into the body 10 and this results in the dispensing of a measured amount of powder P.

Figure 3:
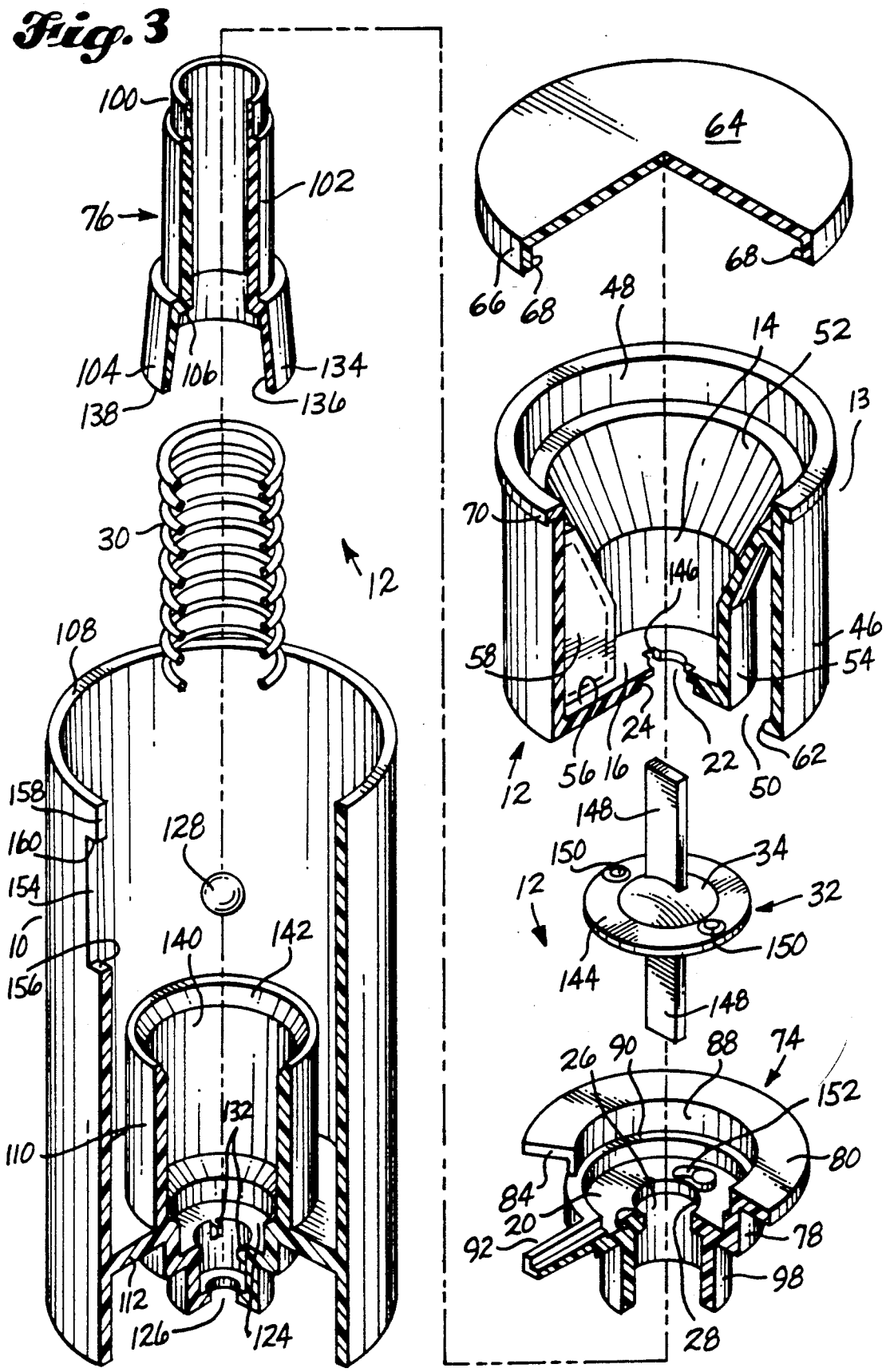
FIG. 3 is an exploded pictorial view of the sprayer, with foreground quarter sections of most of the components removed.
Figures 4, 5, 14:
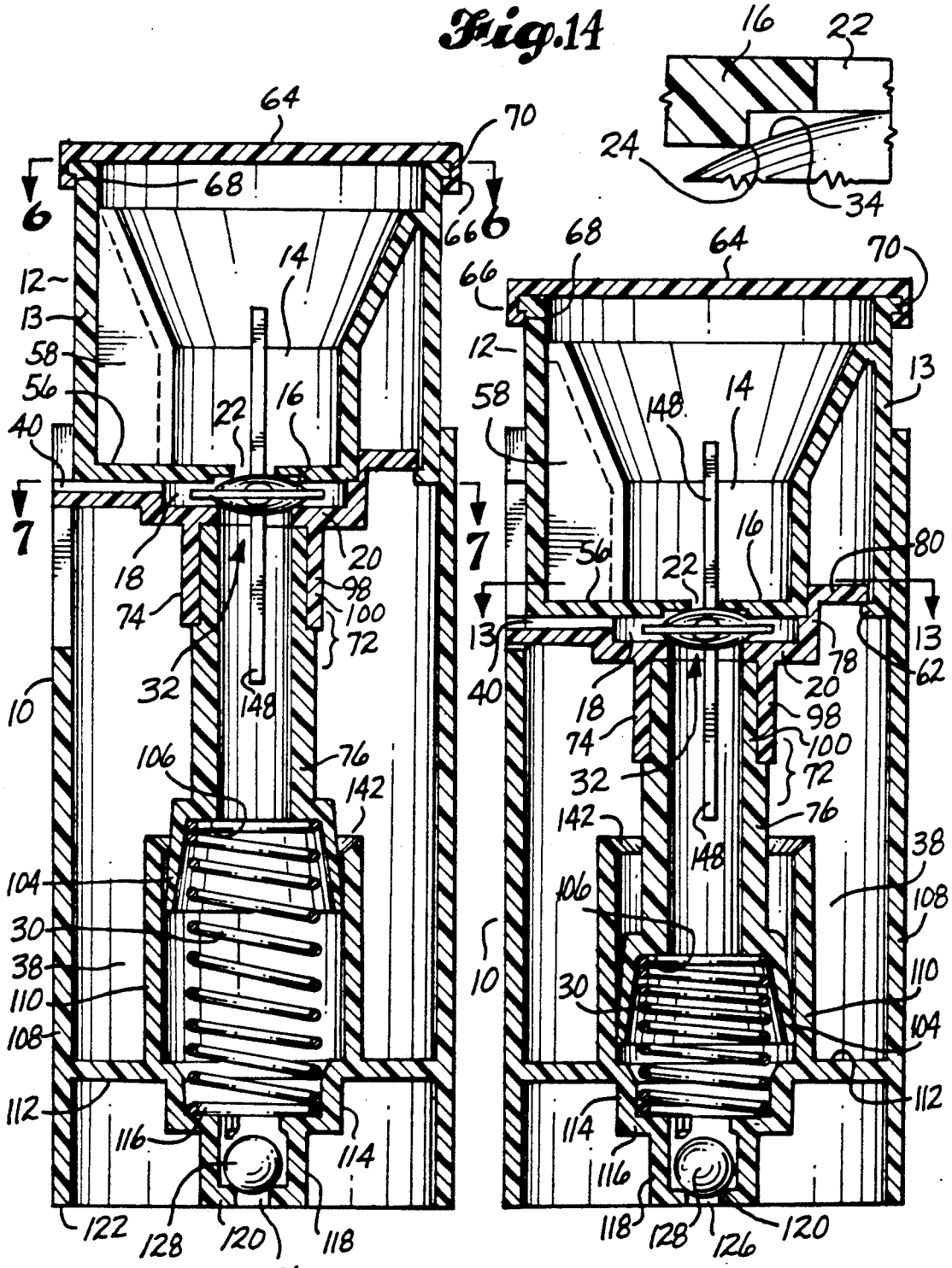
FIG. 4 is an axial sectional view taken substantially along line 4—4 of FIG. 6, such view showing the plunger in an up position.
FIG. 5 is a view like FIG. 4 but showing the plunger in a depressed position.
FIG. 14 an enlarged scale fragmentary view showing contact between the upper surface of the valve plug member and a circular seat that is a part of the bottom wall of the powder reservoir.

Referring to FIGS. 3-5, an upper portion 13 of the plunger 12 includes a powder reservoir 14 having a bottom wall 16. Bottom wall 16 is also the top or first wall of a mixing chamber 18 which is positioned immediately vertically below the powder reservoir 14. The mixing chamber 18 also includes a second or lower wall 20 which is spaced axially downwardly from wall 16. As best shown by FIGS. 4-6 and 8-10, a powder outlet 22 is formed in wall 16. Powder outlet 22 includes a downwardly directed valve seat 24 which is herein sometimes referred to as the upper valve seat. As shown by FIGS. 3-5, 8-10 and 14, a shallow circular recess is formed in the lower portion of wall 16. A circular edge 24 is formed at the outer periphery of this recess. This edge 24 defines the valve seat. When either valve plug surface 34 or 36 is urged upwardly against the seat 24, there is a circular line contact between seat 24 and such surface 34, 36. Wall 20 includes an air inlet 26 which is substantially concentric with the powder outlet 22. Air inlet 26 is immediately surrounded by an upwardly directed valve seat 28 which is herein sometimes referred to as the lower valve seat.

As best shown by FIGS. 4 and 5, a spring 30, located within the tubular body 10, normally biases the plunger 12 upwardly. As shown by FIG. 5, when a downward pressing force is applied on the plunger 12 the spring 30 yields so as to permit the plunger to in response to such force move downwardly into the tubular body 10. When the downward force is removed from the top of the plunger 12 the stored energy in the compressed spring 30 serves to move the plunger 12 upwardly from its depressed position (FIGS. 2 and 5) into its extended position (FIGS. 1 and 4).

An axially movable valve plug 32 is located within the mixing chamber 18. Valve plug 32 includes an upper convex surface 34, directed towards powder outlet 22, and a lower convex surface 36, directed towards air inlet 26. The lower surface 36 normally rests on the lower valve seat 28. This is because the valve plug 32 is under the influence of gravity and gravity urges it downwardly onto the valve seat 28. When the valve plug 32 is on the valve seat 28 the upper surface 34 is spaced from the upper valve seat 24. This provides a gap through which powder can flow downwardly from the powder reservoir 14 into the mixing chamber 18. This procedure will hereinafter be described in greater detail.

As best shown by FIGS. 4 and 5, a pump 38 is housed within the tubular body 10. As will hereinafter be described in greater detail, the pump 38 is operable by a downward movement of the plunger 12 to compress air and pump it upwardly to and through the air inlet 26. The pump air stream moves against the lower surface 36 of the valve plug 32. This applies a force on valve plug 32 which moves it upwardly into seating engagement with the upper valve seat 24. When the valve plug 32 is against valve seat 24 a gap is formed between the lower surface 36 and valve seat 28. The air stream flows through this gap into the mixing chamber 18 where it picks up or entrains the powder that is in the mixing chamber 18 and then carries the powder out through a discharge passageway 40 which extends laterally of the dispenser and includes a side discharge opening, as clearly shown by FIGS. 1 and 2.

Referring to FIGS. 3-7, the plunger part 13 includes a cylindrical outer sidewall 46, an open upper end 48 and a partially open lower end 50. The powder reservoir 14 is defined partially by a downwardly converging upper sidewall 52 (hereinafter the funnel wall 52) and a cylindrical lower sidewall 54. Owing to its downwardly converging character, funnel wall 52 helps influence the flow of powder within reservoir 14 to the powder outlet 22. As best shown by FIGS. 3-6, 8 and 9, a portion 56 of wall 16 extends radially outwardly and connects to outer sidewall 46. A pair of chord walls 58, 60 extend vertically between funnel wall 52 and bottom extension 56 and horizontally between funnel wall 52 and lower wall 54, on the inside, and outer sidewall 46, on the outside. As will be apparent, a chamber 14 (herein the powder reservoir) is formed within plunger part 13, above walls 16, 56. Bottom wall extension 56 is a necessity, it forms a cover or top for the passageway 40. The space defined laterally between chord walls 58, 60 receives a portion of the molding apparatus used to construct plunger part 13.

As shown by FIG. 3, the lower end 50 of plunger part 13 includes an open space between the lower ends of walls 46, 54 which extends circumferentially about part 13 except where it is interrupted by wall portion 56. In the open region, wall 46 includes a radially inwardly projecting lip 62. The purpose or function of this lip 62 is hereinafter described.

As will be appreciated, the open upper end 48 of plunger part 13 serves as a fill opening for powder reservoir 14. Plunger part 13 is normally closed at its top by a cover or lid 64. As illustrated, lid 64 may be a snap on lid. For this purpose it is provided with a sidewall 66 and an inwardly directed lip 68. Sidewall 46 is formed to include an outwardly directed lip 70. Lid 64 is pliable enough that it can be snap fitted onto the top of plunger part 13, with its lip 68 fitting below sidewall lip 70, in the manner illustrated in FIGS. 4 and 5.

Figure 11:
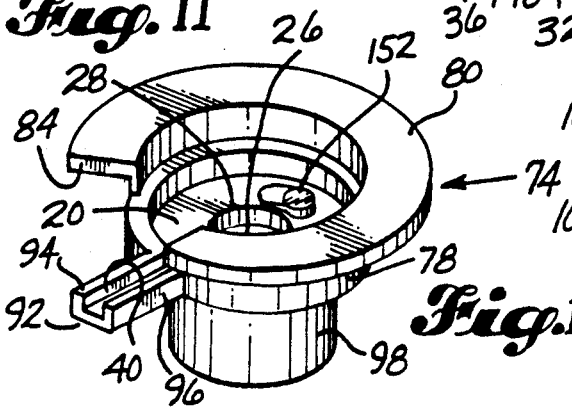
FIG. 11 is a pictorial view taken from above and looking towards the top and outlet channel side of an upper part of the lower portion, of the plunger.

As best shown by FIGS. 3-5, plunger 12 includes a two part lower portion 72 which is connected at its upper end to the lower end of plunger part 13. Upper part 74 of plunger portion 72 is best shown in FIGS. 3 and 11. Lower part 76 of plunger portion 72 is best shown in FIG. 3.

Referring to FIGS. 3 and 11, plunger part 74 includes, in addition to wall 20, a cylindrical sidewall 78 which projects upwardly from the outer periphery of wall 20, and a flange 80 which projects radially outwardly from the upper end of wall 78. A section or sector 82 (FIG. 7) of part 74 is cut away between flange ends 84, 86, for the purpose of allowing part 13 to be rotated a limited amount relative to part 74, after these two parts have been joined. For purposes of joining parts 13, 74, an axial socket 88 is formed in the upper inner portion of wall 78. This socket 88 includes a base surface 90. A channel arm 92 extends radially outwardly from wall 78. It includes a radially extending channel 40. This channel is designated 40 because it, when covered by wall portion 56, defines the discharge passageway 40. Channel 40 is defined by a pair of spaced apart sidewalls 94, 96 interconnected by a web 98. The upper surfaces of walls 94, 96 are in the same plane with socket base 90. The lower central portion of part 13, defined in part by wall 16, is sized to make a close fit within the socket 88. As best shown by FIGS. 4, 5, 8, 9 and 10, the lower surface of wall 16 and wall portion 56 are coplanar and when the parts 13, 74 are assembled they are contiguous the plane which includes the upper surfaces of channel arm walls 94, 96 and socket base 90.

Part 74 also includes a tubular neck 98 which extends downwardly from wall 20. Neck 98 is telescopically joined with the upper end portion 100 of plunger part 76. By way of typical and therefore nonlimitative example, end portion 100 may extend into neck 98. The two parts 98, 100 may be secured together by a tight interference fit. Or, they can be welded together by use of a suitable solvent. Or, they can be glued together.

Part 76 includes a tubular body 102 and a downwardly opening tubular piston 104 at the lower end of body 102. A shoulder 106 is formed where body 102 joins piston 104. Shoulder 106 forms an upper abutment for spring 30.

Body 10 comprises a cylindrical outer wall 108 which extends the full length of body 10. A smaller diameter pump cylinder 110 (herein also air compression chamber 110) is located within the lower portion of body 10. A radial web 112 extends between and interconnects pump cylinder 110 and outer wall 108.

As clearly shown by FIGS. 3-5, pump cylinder 110 extends upwardly from web 112. A smaller diameter tubular wall 114 extends downwardly from web 112 to an annular base wall 116. A yet smaller diameter tubular wall 118 extends downwardly from base wall 116 to an end wall 120. The lower surface of end wall 120 is either coplanar with or spaced above the lower end 122 of outer wall 108. This is so that the body 10 can be set down on a support surface with the end 122 against the support surface.

As clearly shown by FIGS. 3-5, a shoulder 124 is formed where wall 118 joins wall 116. This shoulder 128 forms a lower abutment for the spring 30 (FIGS. 4 and 5). End wall 120 includes a central opening 126. This opening 126 functions as an air inlet. A ball check valve 128 is located within tubular portion 118, immediately above wall 120. As shown by FIGS. 4 and 5, ball 128 is larger in diameter than the air inlet opening 126. The static position of ball 128 is shown in FIGS. 4 and 5. Gravity normally maintains ball 128 seated on a valve seat which surrounds air inlet 126. A plurality of ball retainer lugs 132 are formed on the upper inner portion of tubular wall 118. Lugs 132 project radially inwardly and at their inner ends lie on a circle that is smaller in diameter than the ball 128. The material from which the lugs 132 is constructed is flexible or resilient enough to allow the ball 128 to be pushed downwardly past the lugs 132 into the inlet chamber formed by walls 118, 120. A downward force applied against the ball 128 moves the ball against lugs 132. This deforms the lugs 132 enough to permit passage of the ball 128 downwardly past the lugs 132.

Tubular piston 104 has a frustoconical outer surface 134 and a frustoconical inner surface 136. The flare angle of surface 136 is larger than the flare angle of surface 134. As a result, the tubular sidewall which forms piston 104 is tapered in the downward direction. The maximum outer diameter of piston 104 at location 138 (FIG. 3) makes a tight interference fit with the inner surface 140 (FIG. 3) of pump chamber 110. Pump chamber 110 may include a flared inlet 142 (FIGS. 3-5) to help guide the piston 104 into pump chamber 110 during assembly of the dispenser. Some contraction in diameter of the piston 104, in the region 138, may occur as the piston 104 is pushed into the piston chamber 110. The tapered construction of the piston sidewall makes the piston sidewall flexible enough that it can be compressed to fit into piston cylinder 110 and still be free to move up and down in response to forces applied on it by the spring 30 and a user applied force on the plunger 12.

Valve plug 32 includes a central hub portion on which the upper and lower surfaces 34, 36 are formed, and an annular rim portion 144. As clearly shown by FIGS. 8-10, the rim portion 144 is relatively thin and has upper and lower radial surfaces. Valve plug 32 is constructed to be symmetrical about a transverse center plane. This enables assembly of the valve plug 32 in the dispenser without any regard to which end is directed upwardly or which end is directed downwardly. The two ends are identical and it makes no difference which end is up and which end is down.

As shown by FIGS. 3 and 6, wall 16 is formed to include a transverse key slot 146 Which extends crosswise of the opening 22. This provides key slot portions which extend radially outwardly from the periphery of opening 22. Valve plug 32 includes a pair of axially extending keys 148. The particular key 148 that is directed upwardly extends into the key slot 146. This serves to look the valve plug 32 and plunger part 13 together, in the rotational sense, while permitting axial movement of valve plug 32.

Figure 10:
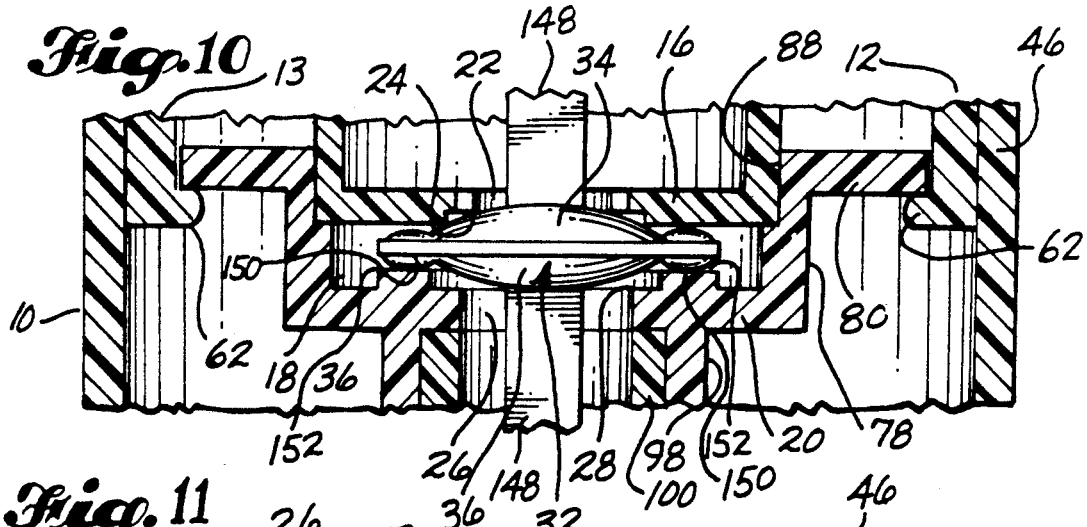
FIG. 10 is a view like FIGS. 8 and 9, but with the upper portion of the plunger rotated relative to the lower portion of the plunger for causing cam action movement of the valve plug upwardly into a position closing the powder outlet.

Rim portion 144 of valve plug 32 is provided with a pair of cam followers 150 on each of its upper and lower surfaces. Cam followers 150 are positioned diametrically opposite each other and may be in alignment with the plane of the keys 148. The cam followers 150 are identical in construction and each is in the nature of a convex protrusion or boss formed on its surface of rim 144. As shown by FIGS. 3, 7, 10 and 11, a pair of lifting cams 152 are formed at diametrically opposed locations on the upper surface of wall 20, radially outwardly of the opening 26. Cams 152 are in the nature of circumferentially extending ramps which start from surface 20 and extend upwardly to an upper end portion spaced axially above the upper surface of wall 20 (Fig. 10).

The assembly of the preferred embodiment will now be described. Firstly, the valve ball 128 is inserted into the inlet chamber immediately above air inlet 126. As previously described, the ball 128 is moved downwardly until it contacts the projections 132. A downward force is then applied to ball 128 for the purpose of forcing it past the projections 132. The force applied to the ball 128 is transmitted by ball 128 to the projection 132, causing a deformation of projections 132 to an extent sufficient to permit passage of ball 128 downwardly past the projection 132. When the ball 128 is in the inlet chamber, below the projections 132, it is prevented by the projections 132 from falling out of the inlet chamber when and if the dispenser is turned upside down. However, an object can be inserted through inlet 126 and moved against ball 128 for forcing ball 128 upwardly past the projections 132 and out from the inlet chamber, if this ever becomes necessary.

Following the insertion of ball 128 into the inlet chamber, the spring 130 is moved downwardly into the piston cylinder 110 and its lower end is positioned against surface 124. Plunger part 74 is connected to plunger part 76. As earlier explained, end portion 100 of tubular body 102 is plug fitted into the neck 98. Solvent may be applied to these parts, so as to weld them together. Or, an adhesive may be used to firmly connect the parts together. Or, the connection may be accomplished by a tight interference fit.

The preferred part assembly sequence is as follows: Firstly, the valve plug 32 is placed into reservoir 12 from the bottom. Then, plunger part 74 is snapped into the reservoir and rotated to close the valve. The reservoir is then filled with powder and the cover 64 is snapped onto the top of the reservoir. The plunger part 76 is then fitted into the assembly and the entire upper moving assembly is positioned over and into the preassembled spring, check ball, and tubular body.

Valve plug 32 is positioned within the mixing chamber 18. Then, plunger part 13 is connected to plunger part 74, in the following manner. The flange 80 on part 74 is inserted upwardly into the annular opening formed at the lower end 50 of part 13. As shown by FIGS. 8-10, the outer peripheral portion of flange 80 is positioned above lip 62 when the parts 13, 74 are joined. The lower portion of wall 54, and end wall 16, are positioned within the socket 88. After the two parts 13, 74 are connected together part 13 is prevented by the engagement of lip 62 with the outer periphery of flange 80 from moving endwise upwardly away from part 74. However, part 13 can be rotated in position relative to part 74.

Figure 12:
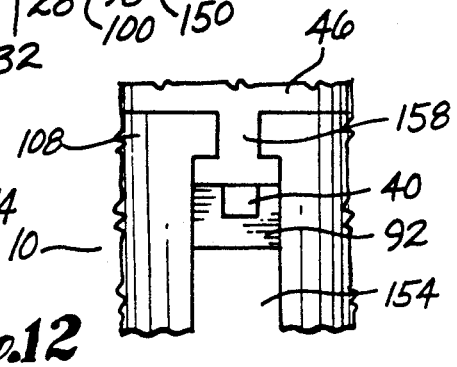
FIG. 12 is an enlarged scale fragmentary side elevational view looking substantially normal to the outer end of the powder discharge passageway.

As best shown by FIGS. 3 and 12, sidewall 108 is formed to include a vertical slot 154 which is closed at its lower end 156. The upper end of slot 154 includes a slot extension 158 which is narrower than slot 154. This forms an inwardly directed pair of tabs on the opposite sides of slot extension 158. A pair of end surfaces are formed where slot 154 meets slot extension 158. Channel arm 92 is slightly smaller in width than slot 154 but is wider than slot extension 158. When the plunger 12 is installed within the housing 10, the upper surfaces of channel sidewalls 94, 96 are biased upwardly by spring 30 into contact with the surfaces 160. The interengagement of channel arm 92 with slot 154 and end surfaces 160 serves to lock the plunger 12 within the housing 10 and hold the lower portion of the plunger 12 against rotation relative to body 10.

The provision of slot extension 158 permits assembly of plunger part 74 into body 10. The wall 108 is flexible enough that the tabs can be bent or deformed to enlarge the slot extension 158 and permit a downward insertion of channel arm 92 into the slot 154. This insertion is done after plunger part 76 has been connected to plunger part 74 and after spring 30 has been positioned between shoulders 106 and 116. As previously stated, when the channel arm 92 is within slot 154, spring 30 is slightly compressed and the stored energy within spring 30 biases the plunger 12 upwardly, forcing channel arm 92 against stop surfaces 160.

As stated above, plunger part 13 is rotatable in position with respect to plunger part 74. The limits of rotation are established by angle 82 and the end walls 58, 60. Specifically, at one end of rotation wall 58 contacts surface 84. At the opposite end of rotation wall 60 contacts surface 86. As will hereinafter be described, the rotation of plunger part 13 moves the cam followers 150 upwardly along cams 152, in a first direction of rotation, and allows cam followers 150 downwardly along the cams 152 due to gravity, in response to gravity upon rotation part 13 in the opposite direction.

For reasons that will be hereinafter apparent, the two rotational positions of plunger part 13 relative to plunger parts 74, 76 and body 10, will be referred to as the "open" and "locked" positions of the dispenser. When the dispenser is in its "open" position, the cam followers 150 are down on the upper surface of wall 20. When the dispenser is in its "looked" position, the cam followers 150 are up on the top portions of the cams 152.

Operation of the dispenser will now be described when the dispenser is in its "open" position. The static position of the dispenser is shown by FIGS. 1 and 4. Powder within reservoir 14 can flow downwardly through the portion of opening 22 that is not occupied by the key 148. This powder will flow through a gap that is formed by and between the valve seat 24 and the upper surface 4 of the valve plug 32. This is shown in FIG. 8. The powder will flow into the portion of mixing chamber 18 that is not occupied by the valve plug 32. The restrictive size of the gap controls the flow of powder into the mixing chamber 18. The powder, being a solid, assumes an angle of repose once within chamber 18. This characteristic of the powder, in combination with the gap size and the small dimension of passageway 40 cooperate to stop powder flow out from chamber 18 through passageway 40 in response to the weight of powder within reservoir 14.

As shown by FIG. 8, the force of gravity normally positions the valve plug 32 against the lower valve seat 28. When the plunger 12 is depressed by the user, several things happen. Firstly, piston 104 is forced downwardly within pump cylinder 110, against the force of spring 30. Downward movement of piston 104 decreases the volume within pump cylinder 110 below the piston 104. Air which is trapped within cylinder chamber 110 between piston 104 and ball 128 is compressed and caused to flow upwardly through the hollow piston rod 76. This moving air exerts a force against surface 36, lifting valve plug 32 upwardly and placing its upper surface 34 into a seating engagement with valve seat 24. This upward displacement of valve plug 32 creates a gap between surface 36 and valve seat 28. The flowing air flows through this gap and into mixing chamber 18.

It moves through mixing chamber 18 and then out through passageway 40. As it moves it entrains the measured quantity of powder which had previously been deposited into the chamber 18. This entrained powder, and its atmospheric air conveyor, flow outwardly as a stream through the passageway 40. At the outer end of passageway 40 the air and powder stream spreads outwardly.

As previously stated, body 10 may be conveniently sized to be held within a user's hand. The user grasps body 10 and places his or her index finger on top of the plunger 12. The plunger 12 is then depressed by a simple downward movement of the user's index finger on the top wall 64. Following a stroke, the finger is lifted, allowing spring 30 to extend plunger 12 upwardly back into the position shown by FIGS. 1 and 4. As plunger 12 moves upwardly, the chamber below piston 104 increases in size. As this happens atmospheric air is drawn into the inlet 126, past the ball 128. Valve plug 32 again moves downwardly and another charge of powder flows downwardly from reservoir 14 into mixing chamber 18. The dispenser is now ready to spray another charge of powder in response to another downward movement of the plunger 12.

The valve plug 32, including the members 148, moves and vibrates in the airstream from the pump. This movement of the plug 32, and the upper part 148, loosens the powder immediately above and adjacent the opening 22. In this manner, there is a positive influence on the powder encouraging it to flow downwardly through opening 22 and into the mixing chamber 18.

When the dispenser is not being used, it is desired that the powder be prevented from falling out from chamber 18 in response to handling movement of the dispenser. This includes during shipment of the product to the retailer. The lock mechanism that has been partially described is provided for this purpose. The user grasps the plunger part 13 in one hand while holding the body 10 in the other hand. Plunger part 13 is then rotated to the extent permitted. The engagement of the upper key 148 within the key slot 146 causes valve plug 34 to rotate with plunger part 13. The lower pair of cam followers 150 are positioned to contact the cams 152. As rotation proceeds, the lower cam followers 150 are moved along the cams 152. The contact between cam followers 150 and cam surfaces 152 forces valve plug 32 upwardly and places its upper surface 34 against the upper valve seat 24. Fig. 10 shows valve plug 32 in its upper position. It shows the upper surface 34 against valve seat 24.

As will be appreciated, detents can be used for locking the dispenser in its "open" and "locked" positions. These detents may comprise a projection on one of members 46, 80, and a detent receiving recess on the other member.

In preferred form, the compression spring 30 and the valve ball 128 are constructed from metal. The remaining parts of the dispenser are constructed from plastic and these parts may be injection molded.

The preferred embodiment is a hand-held dispenser. However, many of the features of the invention could be incorporated into a dispenser that is constructed to sit down on a supporting surface. Also, the mixing chamber 18, powder reservoir 14, and valve plug 32, combined in the manner described, can be incorporated into a system which opens a valve in a line leading from a source of compressed air in a response to a downward movement of the plunger.

The embodiments which have been described are submitted by way of example, to provide a better understanding of the invention. However, the scope of protection is not to be limited by the embodiments which have been illustrated and described, but only by the claims which follow, interpreted in accordance with the established rules of patent claim interpretation, including the use of the doctrine of equivalents.

What is claimed is:

1. A powder dispenser, comprising:

a powder reservoir;

a mixing chamber below the powder reservoir, separated from the powder reservoir by a first wall, said mixing chamber including a second wall below and axially spaced from the first wall, and a discharge passageway extending outwardly from the mixing chamber;

said first wall including a powder outlet bordered by a downwardly directed upper valve seat, and said second wall including an air inlet substantially coaxial with the powder outlet, said air inlet bordered by an upwardly directed lower valve seat;

an axially movable valve plug within the mixing chamber, said valve plug having upper and lower surfaces, said lower surface normally resting on the lower valve seat, with its upper surface spaced axially from the upper valve seat, providing a gap through which powder can flow from the powder reservoir into the mixing chamber; and means to deliver air to and through the air inlet and against the lower surface of the valve plug, to move the valve plug upwardly to place the upper surface of the valve plug into seating engagement with the upper valve seat, and provide a gap between the lower surface of the valve plug and the lower valve seat, whereby air flows through said gap and into the mixing chamber and carries the powder out through the discharge passageway.

2. A powder dispenser according to claim 1, comprising a depressible plunger, said plunger including said mixing chamber, and said means to deliver air including said plunger and operating in response to a downward movement of the plunger to deliver air to and through the air inlet.

3. A powder dispenser according to claim 1, comprising:

a base including a chamber having an open upper end;

a plunger telescopically received within said chamber and including an upper portion, which normally projects upwardly out through the open upper end of the chamber, and a lower portion located within said chamber, said upper portion including the powder reservoir;

a spring within the base normally biasing the plunger upwardly, said spring being yieldable in response to a downward pressing force on a plunger, so as to permit the plunger to in response to such force move into the tubular base; and a pump within the base operable by a downward movement of the plunger to move air upwardly through the air inlet, and against the lower surface of the valve plug, to move the valve plug upwardly to place the upper surface of the valve plug into sweating engagement with the upper valve seat, and provide a gap between the lower surface of the valve plug and the lower valve seat, whereby the air flows through said gap and into the mixing chamber and picks up powder that is in the mixing chamber and carries the powder out through the discharge passageway.

4. A powder dispenser according to claim 3, wherein said pump includes a tubular piston at the lower end of the plunger, an air compression cylinder having an open upper end and a lower closure including an inlet, said inlet including a downwardly closing and upwardly opening check valve, said piston being slidably received within the compression cylinder such that in response to a downward movement of the plunger the check valve will close and air will be trapped and compressed in the air compression cylinder and the air thus compressed will be forced upwardly through the plunger to and through the compressed air inlet.

5. A powder dispenser according to claim 4, wherein said tubular piston is formed by a downwardly and outwardly sloping tubular wall having a downwardly tapered cross section forming a yieldable interference fit with the compression cylinder wall.

6. A powder dispenser according to claim 4, wherein the lower closure of the compression cylinder includes a socket which includes an annular shoulder, and said tubular piston includes an interior confronting shoulder, and said spring is a coil type compression spring having an upper end which is within the tubular piston and against the shoulder within the tubular piston and a lower end which is within the socket and is against the annular shoulder in the socket.

7. A powder dispenser, comprising:

a tubular body adapted to be held in a user's hand and including an open upper end;

a plunger telescopically received within the tubular body and including an upper portion, which normally projects upwardly out through the open end of the tubular body, and a lower portion located within said tubular body, said upper portion including a powder reservoir;

said plunger including a mixing chamber below the powder reservoir, separated from the powder reservoir by a first wall, said mixing chamber including a second wall below and axially spaced from the first wall, and a discharge passageway extending from the mixing chamber laterally out from the plunger;

said first wall including a powder outlet bordered by a downwardly directed upper valve seat, and said second wall including a compressed air inlet substantially coaxial with the powder outlet, bordered by an upwardly directed lower valve seat;

a spring within the tubular body normally biasing the plunger upwardly, said spring being yieldable in response to a downward pressing force on the plunger, so as to permit the plunger to in response to such force move into the tubular body;

an axially movable valve plug within the mixing chamber, said valve plug having upper and lower surfaces, said lower surface normally resting on the lower valve seat, with its upper surface spaced axially from the upper valve seat, providing a gap through which powder can flow from the powder reservoir into the mixing chamber; and a pump within the tubular body operable by a downward movement of the plunger to compress air and pump it upwardly through the compressed air inlet, and against the lower surface of the valve plug, to move the valve plug upwardly to place the upper surface of the valve plug into seating engagement with the upper valve seat, and provide a gap between the lower surface of the valve plug and the lower valve seat, whereby the compressed air flows through said gap and into the mixing chamber and picks up powder that is in the mixing chamber and carries the powder out through the discharge passageway.

8. A powder dispenser according to claim 7, wherein the upper portion of the plunger comprises a tubular sidewall having an open upper end, said open upper end communicating with the reservoir, and said plunger includes a cover for said open end which is detachably connected to the upper portion of the plunger.

9. A powder dispenser according to claim 7, wherein said powder reservoir includes a downwardly converging sidewall functioning to influence powder flow towards the powder outlet.

10. A powder dispenser according to claim 9, wherein the upper portion, includes a pair of support walls extending chordwise outwardly from the sidewall, and wherein said first wall includes a portion extending radially outwardly below the support walls, said first wall portion forming an upper closure for the discharge passageway.

11. A powder dispenser according to claim 7, wherein said upper and lower portions of the plunger are separately formed and are connected together, and said first wall is a part of the upper portion and the second wall is a part of the lower portion.

12. A powder dispenser according to claim 11, wherein said upper and lower portions of the plunger include complementary components of a snap-together connection and said connection serves to connect the upper and lower portions together.

13. A powder dispenser according to claim 11, wherein the upper portion of the plunger includes a lower part which includes said first wall and the lower portion of the plunger includes an upwardly opening socket into which said lower part is received.

14. A powder dispenser according to claim 11, wherein the lower portion of the plunger includes an upper part which includes said second wall and an upwardly opening channel extending radially outwardly from said mixing chamber, with a portion of the first wall overlying and forming an upper closure for said channel, and with said channel forming said discharge passageway.

15. A powder dispenser according to claim 14, wherein said tubular body includes a tubular outer wall and said wall includes a vertically elongated slot, wherein the upper part of the lower portion of the plunger includes a channel arm in which said channel is formed, wherein said channel arm extends radially outwardly into said slot, and wherein said slot includes an upper end boundary which is contacted by said channel arm when the plunger is in an up position and functions as a stop, to hold the plunger within the tubular body.

16. A powder dispenser according to claim 15, wherein said slot includes a narrow upper end portion which is narrower than the channel arm, and a main portion below the upper end portion which is wider than the channel arm, said upper end boundary being a shoulder formed where the main portion of the slot joins the narrow upper end portion of the slot, with the tubular outer wall including portions on opposite sides of the narrow upper end portion of the slot which are deformable to permit assembly of the plunger within the tubular body and the channel arm within the slot.

17. A powder dispenser according to claim 15, wherein the upper portion of the plunger includes a tubular outer wall and a tubular inner wall, and wherein the upper closure for said channel includes the portion of the first wall and a pair of support walls extending between the tubular outer wall and the tubular inner wall of the upper portion of the plunger.

18. A powder dispenser according to claim 7, further including means for moving the valve plug upwardly, to place and hold its upper surface in seating engagement with the upper valve seat, to in that manner close off the powder outlet.

19. A powder dispenser acoording to claim 18, wherein said upper portion of the plunger is rotatable relative to the lower portion of the plunger, wherein said means for moving includes at least one cam on the second wall, said cam inclining from a lower end to an upper end which is spaced axially above the second wall, at least one cam follower extending axially downwardly from the valve plug, said cam and cam follower being moved into engagement with each other to raise the valve plug upwardly into seating engagement with the upper valve seat in response to a rotation of the upper portion of the plunger relative, to the lower portion of the plunger.

20. A powder dispenser according to claim 19, wherein the lower portion of the plunger includes an upwardly opening socket into which a lower part of the upper portion is received, and a flange extending radially outwardly from the socket, said tubular outer wall of the upper portion of the plunger including a lower lip, said flange and said lip forming complementary components of a snap-together connection and said connection serving to connect the upper and lower portions.

21. A powder dispenser according to claim 19, comprising a pair of cams and a pair of cam followers of the type described, positioned diametrically across the second wall and the valve plug, respectively, said pair of cams and cam followers functioning together to provide balanced operation of the valve plug.

22. A powder dispenser according to claim 18, wherein said first wall includes a key slot adjacent said powder outlet and said valve plug includes a key extending from the valve plug axially upwardly through the key slot, said key and key slot serving to couple together the valve plug and the upper portion of the plunger when the upper portion is rotated.

23. A powder dispenser according to claim 20, wherein said valve plug is symmetrical about a transverse plane taken between the upper and lower surfaces, so that the valve plug can be installed either end up and will function the same regardless of which end is up and which end is down.

24. A powder dispenser according to claim 22, wherein said valve plug includes a first key extending axially upwardly from the valve plug through the key slot and a second key extending from the valve plug axially downwardly through the compressed air inlet, said first and second keys being symmetrical about a transverse plane taken between the upper and lower surfaces of the valve plug, and said at least one cam follower extending axially downwardly from the valve plug and having a corresponding cam follower extending axially upwardly from the valve plug such that the valve plug is symmetrical about the transverse plane with respect to the cam follower, whereby the valve plug can be installed either end up and will function the same regardless of which end is up and which end is down.

25. A powder dispenser according to claim 22, wherein said key extends axially upwardly into the powder reservoir and functions to influence movement of powder toward the powder outlet in response to a movement of the dispenser.

26. A powder dispenser according to claim 7, wherein the pump includes:

a tubular piston at the lower end of the plunger;

an air compression cylinder having an axially directed cylinder wall concentrically positioned within a lower end portion of the tubular body, said cylinder having an open upper end and a lower closure including an inlet, said inlet including a downwardly closing and upwardly opening check valve; and said piston being slidably received within the compression cylinder such that in response to a downward movement of the plunger the check valve will close and air will be trapped and compressed in the air compression cylinder and the air thus compressed will be forced upwardly through the plunger to and through the compressed air inlet.

27. A powder dispenser according to claim 26, wherein the tubular body includes a tubular outer wall and the air compression cylinder is smaller in diameter than the tubular outer wall and said tubular body includes a transverse web extending between and interconnecting the air compression cylinder and the tubular outer wall.

28. A powder dispenser according to claim 27, wherein the lower portion of the plunger includes the second wall, a tubular neck extending downwardly from the second wall, the tubular piston, and a tubular piston rod, said tubular piston rod having an upper end portion which is formed separate from the tubular neck and telescopically engages the tubular neck.

29. A powder dispenser according to claim 26, wherein said tubular piston is formed by a downwardly and outwardly sloping tubular wall having a lower edge portion that is snugly received in the compression cylinder wall.

30. A powder dispenser according to claim 29, wherein the tubular wall of the tubular piston includes a downwardly tapered cross section forming a yieldable interference fit with the compression cylinder wall.

31. A powder dispenser according to claim 26, wherein the lower closure of the compression cylinder includes a socket which includes an annular shoulder, and said tubular piston includes an interior confronting shoulder, and said spring is a coil type compression spring having an upper end which is within the tubular piston and against the shoulder within the tubular piston and a lower end which is within the socket and is against the annular shoulder in the socket.

32. A powder dispenser according to claim 31, wherein the lower closure of the air compression cylinder includes a tubular wall extending axially downwardly from said socket and a lower end wall, said inlet being formed in said lower end wall, and wherein the check valve includes a valve seat surrounding the inlet and a ball within said tubular portion.

33. A powder dispenser according to claim 32, wherein the tubular wall extending axially downwardly from the socket includes at least one ball retaining member projecting radially inwardly from the tubular wall at a location above the ball so as to prevent the ball from moving out from the tubular portion, said ball retaining member being deformable to permit passage of the ball past it into the tubular portion and into a position adjacent the inlet.

* * * * *

UNITED STATES PATENT AND TRADEMARK OFFICE

CERTIFICATE OF CORRECTION

PATENT NO. : 5,082,148

DATED : January 21, 1992

INVENTOR(S) : Walter B. Dunning

It is certified that error appears in the above-identified patent and that said Letters Patent is hereby corrected as shown below:

In the Abstract, 15th line from the bottom, "flow" should be -- flows --.

Column 2, line 16, there is a period after "inlet".

Column 6, line 48, "Which" should be -- which --.

Column 6, line 54, "look" should be -- lock --.

Column 8, line 32, "looked" should be -- locked--.

Column 8, line 42, "surface 4" should be -- surface 34 --.

Claim 3, column 10, line 64, "sweating" should be -- seating --.

Claim 19, column 13, line 13, "acoording" should be -- according -.

Claim 23, column 13, line 47, "claim 20" should be -- claim 22 --.

Signed and Sealed this

Eleventh Day of May, 1993

*Attest:*

Michael K. Kirk

MICHAEL K. KIRK

*Attesting Officer*

*Acting Commissioner of Patents and Trademarks*